United States Patent [19]

Benda et al.

[11] 4,073,558

[45] Feb. 14, 1978

[54] CATHODE RAY TUBE FABRICATING PROCESS

[75] Inventors: David Benda, Genève; Franklin G. Reigel, Waterloo, both of N.Y.

[73] Assignee: GTE Sylvania Incorporated, Stamford, Conn.

[21] Appl. No.: 790,499

[22] Filed: Apr. 25, 1977

[51] Int. Cl.[2] ..... H01J 9/385

[52] U.S. Cl. ..... 316/18; 316/24

[58] Field of Search ..... 316/18, 21, 24, 30

[56] References Cited

U.S. PATENT DOCUMENTS

| | | | |
|---|---|---|---|
| 2,903,319 | 9/1959 | Kuryla et al. | 316/18 |
| 3,712,700 | 1/1973 | Sommer | 316/18 |
| 3,978,563 | 9/1976 | Schol et al. | 29/25.17 |

*Primary Examiner*—Richard B. Lazarus

*Attorney, Agent, or Firm*—Norman J. O'Malley; Thomas H. Buffton; Robert T. Orner

[57] ABSTRACT

A process for fabricating cathode ray tubes having an envelope which contains an electron gun assembly and unwanted water vapor includes the steps of loading the cathode ray tube onto an exhaust machine, heating the cathode ray tube to an internal temperature greater than the condensation temperature of the water vapor during evacuation, and evacuating the water vapor from the envelope.

5 Claims, 2 Drawing Figures

CATHODE RAY TUBE FABRICATING PROCESS

BACKGROUND OF THE INVENTION

This invention relates to cathode ray tube fabrication and more particularly to a process for removing undesired gases from within a cathode ray tube envelope without deleterious effects upon the cathode ray tube assembly.

Generally, cathode ray tubes include an envelope having a funnel-portion and a neck portion with a viewing screen affixed to one end and the neck portion affixed to the opposite end of the funnel portion. An electron gun assembly is sealed into the neck portion and usually includes a plurality of electron guns aligned in either a delta or an in-line configuration. Also, each electron gun has a potentially electron emissive coating thereon including a mixture of carbonates held together by a binder and affixed thereto prior to processing of the cathode ray tube.

In processing the cathode ray tube, the envelope containing the viewing screen is deposited onto a sealing machine. The electron gun assembly is also deposited onto the sealing machine. The sealing machine positionally locates the electron gun assembly within the neck portion of the cathode ray tube. Thereafter, heat is applied to the junction of the electron gun assembly and the envelope of the cathode ray tube in an amount sufficient to effect a glass seal therebetween.

During the above-mentioned sealing process, it has been found that temperatures within the envelope reach the range of about 300°–450° C. Since the most common form of binder material utilized with carbonate mixtures to provide coatings for electron gun cathodes is in the form of a nitrocellulose and nitrocellulose tends to decompose at the above-mentioned range of temperatures, it has been found that the coating on the electron gun cathodes after the sealing process has been completed is in the form of a relatively weakly bonded carbonate mixture.

Also, it has been found that the weakly bonded carbonate mixture is readily susceptible to damage during the exhaust cycle of the cathode ray tube fabricating process. Specifically, it has been found that the envelope of the cathode ray tube includes water vapor and upon evacuation of the envelope the water vapor is condensed to provide droplets of water. In turn, the water droplets are rapidly drawn toward the weakly bonded carbonate mixture on the cathode electrode during the evacuation process and tend to seriously damage the carbonate mixture which is obviously deleterious to the cathode ray tube structure.

In one known attempt to alleviate the above-mentioned unacceptable conditions, a second binder having a higher decomposition temperature was mixed with the first binder and employed to affix a suspension of carbonates to the cathode structure. The second binder was a synthetic resin such as a mixture of condensation products of phenol and farfural and is resistant to temperatures in the 300°–450° C range and decomposes at temperatures in the range of about 1200° C.

Another known attempt to inhibit a deleterious effect on the cathode coating during the exhaust cycle is set forth in U.S. Pat. No. 3,978,563 issued on Sept. 7, 1976 to Schol et al. Therein, a dual binder system is employed with a first binder of the ordinary nitrocellulose type and a second binder selected from the group consisting of polyimides, highly molecular resins and nylon types.

Although each of the above-mentioned double-binder techniques appears to offer some relief to the untenable damage to the cathode coating during the exhaust cycle, it was found that each leaves something to be desired. For example, dual binder systems are expensive to provide, cumbersome to utilize, the tend to cause a multitude of viscosity and deterioriation problems.

OBJECTS AND SUMMARY OF THE INVENTION

An object of the present invention is to provide an enhanced cathode ray tube fabricating process. Another object of the invention is to provide an improved cathode ray tube fabricating process wherein damage to the cathode coating of the cathode ray tube is inhibited. Still another object of the invention is to provide an improved cathode ray tube fabricating process which is inexpensive of labor, materials, and apparatus.

These and other objects, advantages and capabilities are achieved in one aspect of the invention by a cathode ray tube fabricating process wherein the cathode ray tube is loaded onto an exhaust machine, heated to an internal temperature greater than the temperature of condensation of water vapor, and evacuated and heated to remove the water vapor and undesired gases from the cathode ray tube and process the cathode electrode therein.

PREFERRED EMBODIMENT OF THE INVENTION

For a better understanding of the present invention, together with other and further objects, advantages and capabilities thereof, reference is made to the following disclosure and appended claims in connection with the accompanying drawings.

Figure 1:
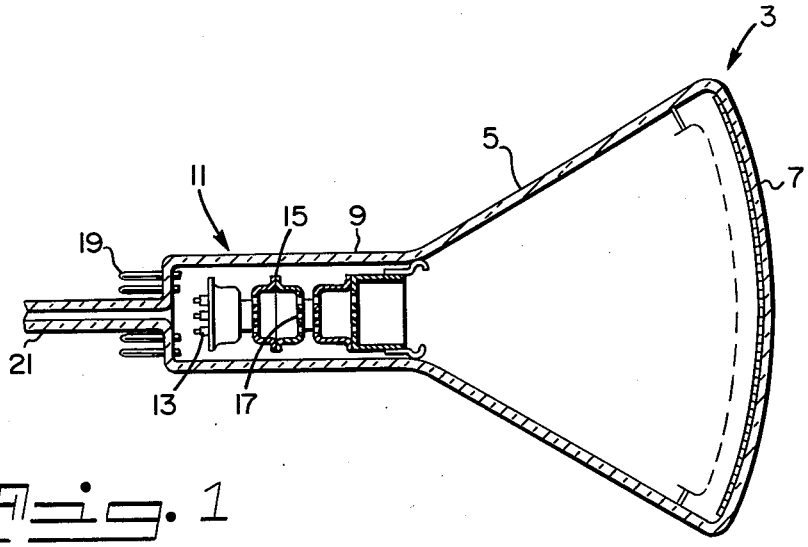
FIG. 1 illustrates a cathode ray tube structure suitable for disposal on an exhaust machine.

Referring to the drawings, FIG. 1 illustrates a cathode ray tube having an envelope 3 which includes a funnel-portion 5 having a viewing screen 7 affixed to one end and a neck-portion 9 affixed to the opposite end. An electron gun assembly 11 includes a plurality of electron guns 13 disposed in either an in-line or delta configuration. A series of grid electrodes 15 each having apertures 17 are spaced from the electron guns 13 and a plurality of pins 19 extend through the envelope 3 to provide for electrical connections to the electron gun assembly 11. Also, an exhaust tube 21 extends from the envelope 3 to provide a capability for evacuation of the envelope 3.

In a manner well known in the art, the electron gun assembly 11 is sealed into the neck portion 9 of the envelope 3 on what is called a sealing machine. Thereon, heat is applied to the neck portion 9 and gun assembly 11 in an amount sufficient to effect a seal therebetween. Moreover, the heat necessary to achieve the desired sealing tends to cause the electron gun assembly to reach temperatures in the range of about 300°–450° C.

As is also well known, the cathode electrode of each of the electron guns 13 of the electron gun assembly 11 has a coating of potentially electron emissive material thereon which includes a mixture of carbonates in a nitrocellulose binder. This nitrocellulose binder decomposes by the time the temperatures reach about 300°–450° C which leaves a coating of relatively weakly bonded carbonates affixed to the cathode electrode of each of the electron guns 13.

As previously stated, the above described cathode ray tube is normally loaded onto an exhaust machine and simultaneously evacuated and heated to remove undesired contaminants and gases from the envelope 3 via the exhaust tube 21. However, it has been found that water vapor present within the envelope 3 tends to condense during the evacuation and forms water droplets which are rapidly directed toward the coating of relatively weakly bonded carbonates. As a result, the water droplets tend to disfigure the coating which is deleterious to production of acceptable cathode ray tubes. Actually, the fast moving water droplets tend to form a funnel-like disfiguration of the cathode coating layer rendering the electron emissive capabilities thereof inadequate or at the very least greatly reduced.

Figure 2:
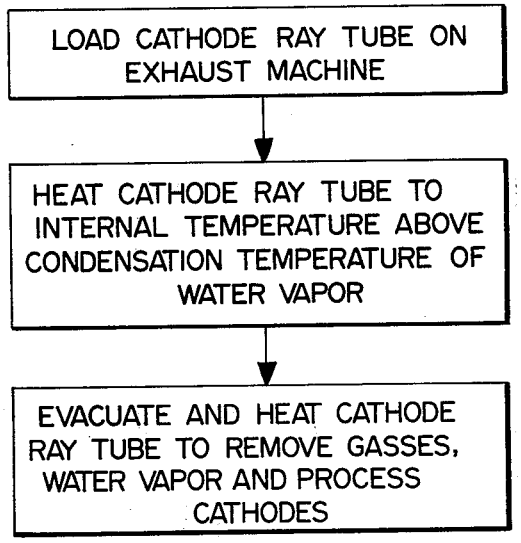
FIG. 2 is a flow chart illustrating a preferred method for fabricating cathode ray tubes.

Referring to FIG. 2, after sealing the electron gun assembly 11 to the neck portion 9 of the envelope 3, the cathode ray tube is loaded onto an exhaust machine which includes heating and evacuation apparatus to remove the unwanted gases from within the envelope 3. However, the heating apparatus is first activated for a period sufficient to cause temperatures internal of the envelope 3 to be greater than the condensation temperature of the water vapor therein when subjected to an evacuation process. Preferably, the internal temperature is raised to a range of about 40′–70° C prior to evacuation of the envelope.

Thereafter, the cathode ray tube is subjected to simultaneous evacuation and heating to cause further activation of the coating on the cathode electrodes and to effect removal of any undesired contaminant gases and water vapor from the envelope 3. After the simultaneous heating and evacuation, the envelope 3 is sealed by deformation of the exhaust tube 21 and processing is completed in the normal manner.

Thus, there has been provided a unique process for fabricating cathode ray tubes wherein the normal nitrocellulose binder-carbonate mixture cathode electrode coating is not deleteriously disfigured during the processing cycle. The process is inexpensive of adaptation and merely requires sequential rather than simultaneous heating and evacuation at pre-designated temperatures during the early portion of the exhaust cycle.

While there has been shown and described what is at present considered the preferred embodiments of the invention, it will be obvious to those skilled in the art that various changes and modifications may be made therein without departing from the scope of the invention as defined by the appended claims.

I claim:

1. A process for fabricating a cathode ray tube having an envelope with a funnel portion including a viewing screen and a neck portion including an electron gun assembly and said envelope having unwanted gases therein including water vapor, said process comprising the steps of:

loading said cathode ray tube onto a cathode ray tube exhaust machine which includes evacuating and heating apparatus;

activating said heating apparatus to provide a temperature internal of said envelope in the range of about 40°–70° C; and subsequently activating said evacuating apparatus to effect removal of said unwanted gases and water vapor from said envelope while said envelope is heated in said range.

2. The process of claim 1 wherein said electron gun assembly is of the in-line type having a plurality of electron guns aligned in a single plane.

3. The process of claim 1 wherein said electron gun assembly reaches temperatures in the range of about 300°–450° C during sealing thereof into said neck portion of said envelope and said electron gun assembly includes cathode electrodes having an emissive coating thereon with a binder material at least partially decomposed by said temperatures prior to said step of loading said cathode ray tube onto said exhaust machine.

4. In a process for fabricating a cathode ray tube having an envelope with funnel and neck portions and containing a viewing screen, electron gun assembly, and unwanted gases including water vapor, the steps of:

loading said cathode ray tube onto an exhaust machine which includes heating and evacuating apparatus;

heating said cathode ray tube to an internal temperature in the range of about 40°–70° C; and subsequently evacuating and heating said cathode ray tube to effect removal of said unwanted gases and said water vapor while said cathode ray tube is heated in said range.

5. In the cathode ray tube fabricating process of claim 1, the step of heating said cathode ray tube to a temperature in the range of about 300°–450° C during sealing of said electron gun assembly into said neck portion of said envelope and effecting at least partial decomposition of binder material in a cathode coating included in said electron gun assembly prior to said step of loading said cathode ray tube onto said exhaust machine.

* * * * *

UNITED STATES PATENT AND TRADEMARK OFFICE

CERTIFICATE OF CORRECTION

PATENT NO. : 4,073,558

DATED : February 14, 1978

INVENTOR(S) : David Benda and Franklin G. Reigel

It is certified that error appears in the above-identified patent and that said Letters Patent are hereby corrected as shown below:

Col. 3, line 33: "$40'$-$70^{\circ}$" should read --- $40^{\circ}$-$70^{\circ}$ ---

Col. 4, Heading: "I Claim" should read --- WHAT IS CLAIMED IS:---

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*